US009414720B2

(12) United States Patent
Salvatori

(10) Patent No.: US 9,414,720 B2
(45) Date of Patent: Aug. 16, 2016

(54) SHOWER TRAY

(71) Applicant: ALFREDO SALVATORI S.R.L., Seravezza (IT)

(72) Inventor: Gabriele Salvatori, Querceta (IT)

(73) Assignee: ALFREDO SALVATORI S.R.L., Seravezza (IT)

( * ) Notice: Subject to any disclaimer, the term of this patent is extended or adjusted under 35 U.S.C. 154(b) by 101 days.

(21) Appl. No.: 14/595,485

(22) Filed: Jan. 13, 2015

(65) Prior Publication Data

US 2015/0208876 A1 Jul. 30, 2015

(30) Foreign Application Priority Data

Jan. 28, 2014 (IT) ..... MI2014A0109

(51) Int. Cl.
*A47K 13/00* (2006.01)
*A47K 3/40* (2006.01)

(52) U.S. Cl.
CPC .. *A47K 3/40* (2013.01); *A47K 3/405* (2013.01)

(58) Field of Classification Search
CPC ..... A47K 3/40; A47K 3/405; E03F 5/04; E03F 5/0407; E03F 5/0408
USPC ..... 4/612, 613, 679, 696; 52/302.1
See application file for complete search history.

(56) References Cited

U.S. PATENT DOCUMENTS

| | | | | |
|---|---|---|---|---|
| 3,551,918 A * | 1/1971 | Bergmark | A47K 3/281 4/613 |
| 4,198,715 A * | 4/1980 | Daniels | A47K 3/284 4/612 |
| 5,418,036 A * | 5/1995 | Tokikawa | E04F 15/02005 404/134 |
| 6,240,578 B1 * | 6/2001 | Planella | A47K 3/40 4/612 |
| 6,571,406 B2 * | 6/2003 | Gerloff | A47K 3/16 4/613 |
| 7,225,480 B2 * | 6/2007 | Mascheroni | A47K 3/40 4/612 |

FOREIGN PATENT DOCUMENTS

| | | |
|---|---|---|
| DE | 19847204 | 3/2000 |
| DE | 102006007471 A1 | 8/2007 |
| ES | 2359397 | 5/2011 |

* cited by examiner

*Primary Examiner* — Paul R Durand
*Assistant Examiner* — Nicholas Ros
(74) *Attorney, Agent, or Firm* — Pearne & Gordon LLP

(57) ABSTRACT

A shower tray comprises a metal structure (2) and a plurality of plates (3), the structure (2) in metal material comprising an upper peripheral frame (4), a bottom wall (6), and side walls (7) defining a collection tank, the metal structure (2) comprising at least one hole (8) for a drain pipe, the structure (2) in metal material further comprising a plurality of cross bars (9) extending between two opposite side walls (7), arranged in contact with the bottom wall (6) and comprising protuberances (10) projecting on the opposite side with respect to the bottom wall (6), each plate (3) comprising a first (3*a*) and a second (3*b*) surfaces that are mutually opposite, the first surface (3*a*) comprising grooves (11) designed to engage corresponding protuberances (10) of the cross bars (9).

10 Claims, 3 Drawing Sheets

SHOWER TRAY

TECHNICAL FIELD

The present invention relates to a shower tray, of the type that can be installed in houses, hotels, apartment complexes, and the like.

BACKGROUND OF THE INVENTION

The bathroom furniture field is constantly looking for innovative technical solutions to be able to meet the increasingly demanding needs of architects and designers.

One of such needs relates to shower trays. In fact, several types of shower trays exist, each of which has been developed depending on the type of installation which it is intended to. Particularly, the shower trays can be divided into two macro-categories, inside which models that are different from one another in shape and dimension are present bet. Such two macro-categories relates to shower trays which can be installed flush with the surrounding floor, i.e., which can be installed so as to lie on the same plane defined by the coating of the screed of the room housing the shower, and to shower trays which can be installed in elevation with respect to the surrounding floor.

The shower trays of the prior art, whether they are floor flush shower trays or in elevation with respect to the floor, are usually composed of a monolithic member, for example, made of ceramic, provided with a frame defining the shower tray footprint and with a hole arranged to be connected to a drain pipe. A resting plane of the shower tray (the one on which the user stands when using the shower) that usually has the above-mentioned drain hole is defined inside the frame. The shape and configuration of the frame are dictated by the type of installation of the shower tray; floor flush shower trays have frames that are different in structure and configuration from the elevation shower trays. Such different structure of the frames is mainly required due to structural and operating reasons of the shower tray.

In fact, in the floor flush shower trays, it is necessary to ensure that the frame is coplanar to the resting plane (and to the coating of the room floor) and that no water leakages are present between the frame and the floor coating (to prevent the water from reaching the screed). This involves the presence of undercuts, protuberances, or the like in the frame intended to receive waterproof members to be sandwiched between the frame and the floor.

In the shower trays in elevation with respect to the floor, the resting plane usually lies on a lower a plane than that of the frame, so as to implement a step that holds the water inside the shower tray. The frame part that faces the room (i.e., opposite the one facing the resting plane) is usually shaped so as to exhibit pleasant aesthetical impact, since it remains visible, and therefore it is usually free from undercuts, protuberances, or the like.

Therefore, it shall be apparent that floor flush shower trays cannot be installed in elevation, and that elevation shower trays cannot be installed flush with the floor.

This involves the need for the shower tray manufacturers to arrange production lines and warehouses for both the macro-categories of shower trays, thus increasing the manufacturing and storage costs.

Again, the aesthetic and chromatic variants of the shower trays that each manufacturer propose have to be replicated on both types of shower trays, forcing the manufacturers to limit such variants in order to contain the manufacturing and, especially the storage costs.

Furthermore, the shower trays vendors are often forced to limit the number of possible aesthetic and chromatic variants that are physically displayed at sale points (due to the overall dimensions taken by each shower tray), limiting the possible selection of the end user, particularly in the case of private purchasers who, since they are not architects or designers, are barely able to imagine the real aesthetic impact of a shower tray merely illustrated in a catalogue.

In this context, the technical task of the present invention is to propose a shower tray that is free from the drawbacks set forth above.

Particularly, the object of the present invention is to provide a shower tray that allows reducing the space necessary to store the same chromatic and aesthetic variations of shower trays flush with the floor and in elevation.

A further object of the present invention is to propose a shower tray that allows displaying a high number of chromatic and aesthetic variations, whether they are referred to flush shower trays or elevation shower trays.

SUMMARY OF THE INVENTION

In accordance with the present invention, the proposed technical task and object are achieved by a shower tray according to the characteristics of one or more of the appended claims.

BRIEF DESCRIPTION OF THE DRAWINGS

The characteristics and advantages of the present invention will be apparent from the following detailed description of a preferred embodiment, illustrated by way of non-limiting example in the appended drawings, in which.

Figure 1:
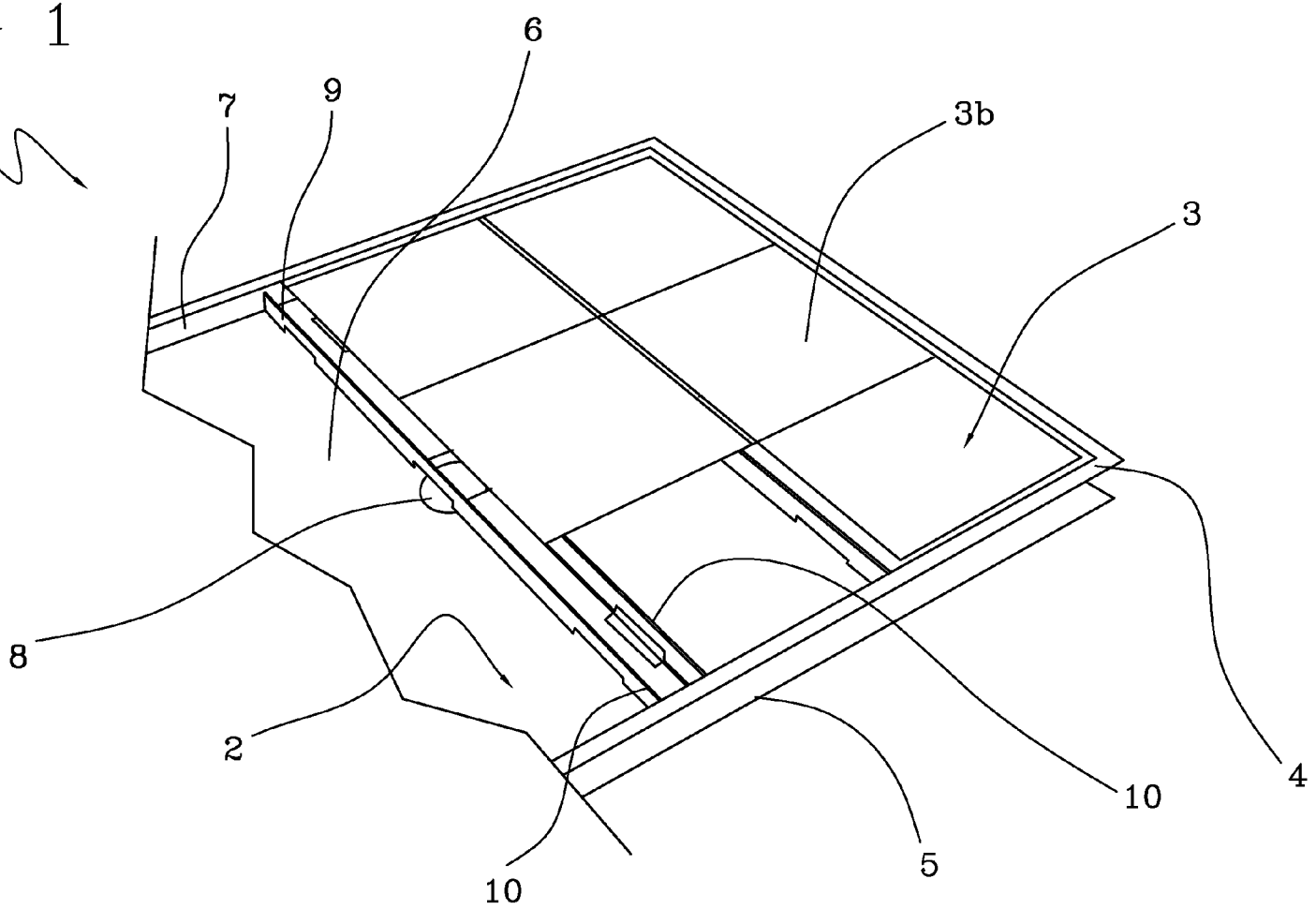
FIG. 1 shows a perspective schematic view, partially interrupted, of a shower tray in accordance with the present invention.
Figure 2:
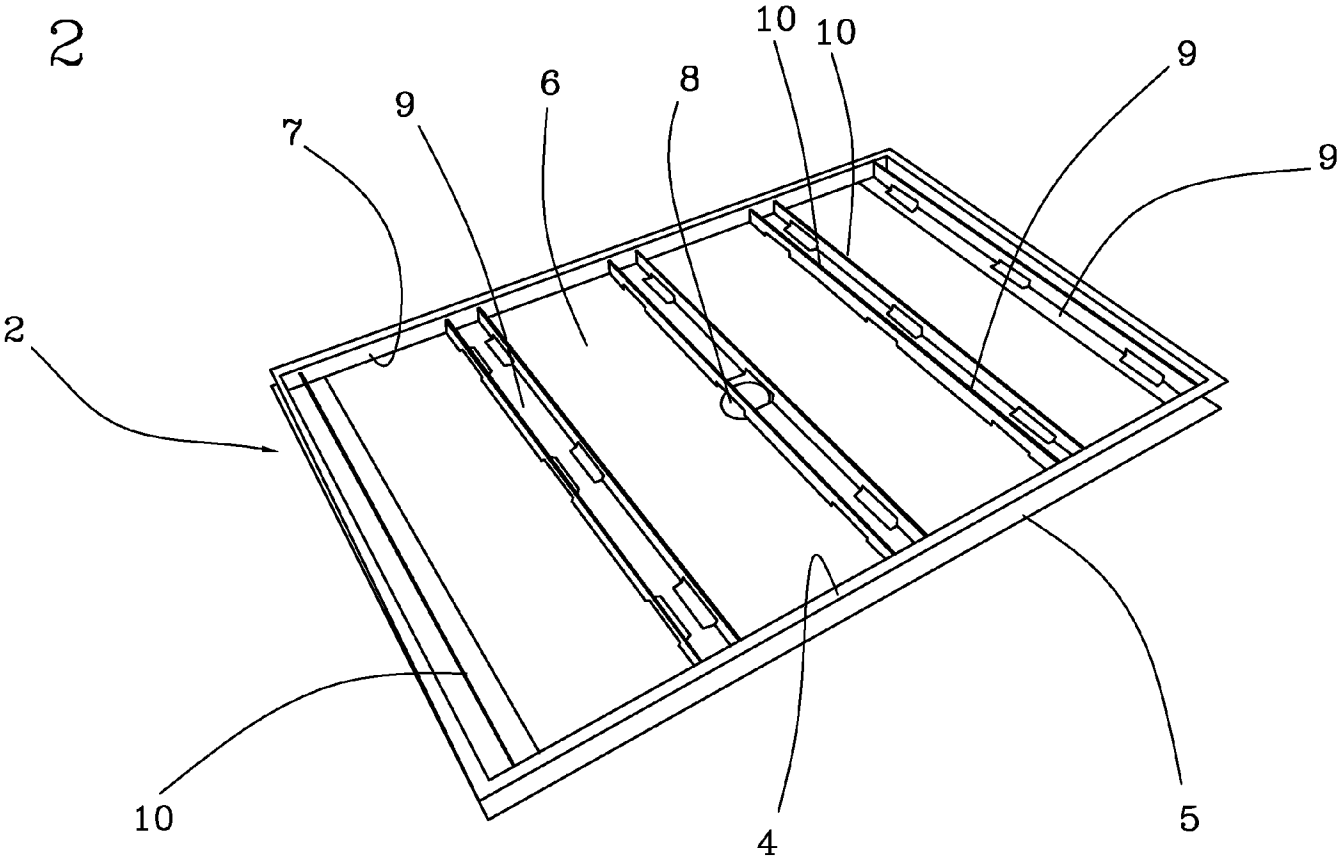
FIG. 2 shows a perspective schematic view of a detail of FIG. 1.

The device illustrated in the appended figures has to be meant as illustrated schematically illustrated, not necessarily in scale, and not necessarily with the represented proportions between the various constitutive elements.

DESCRIPTION OF THE PREFERRED EMBODIMENT

With reference to the appended figures, a shower tray in accordance with the present invention has been generally indicated with the number 1.

The shower tray 1 comprises a structure 2 preferably made of a metal material and a plurality of plates 3, preferably having a constant thickness and a rectangular or squared shape, physically distinct from the structure 2 and intended to constrain resting onto the latter.

The structure 2 in metal material comprises an upper peripheral frame 4, a lower peripheral frame 5, a bottom wall 6, and side walls 7 joining the peripheral frames 4, 5 to the bottom wall 6 to define a waterproof collection tank.

The collection tank has the function of receiving water and conveying it towards a hole 8 intended to be connected with a drain pipe. Preferably, such hole 8 is provided for on the bottom wall 6.

Preferably, the side walls 7 integrate corresponding portions of the upper 4 and the lower 5 peripheral frames. Particularly, each side wall 7 is made of a metal section bar having a "C"-shaped section, wherein the upper horizontal tab defines an upper frame portion 5, the horizontal tab lower defines a lower frame portion 6, and the central portion defines a side wall 7. The bottom wall 7 is made integral to the side walls 7 in the proximity of the lower frame 6.

The structure in metal material further comprises a plurality of cross bars 9 extending between two opposite side walls 7. The cross bars 9 are put in contact with continuity or at some portions, with the bottom wall 6. The cross bars 9 are further in contact, and preferably firmly constrained, to two opposite side walls 7. The cross bars 9 comprise protuberances 10 projecting on the opposite side with respect to the bottom wall 6. In the preferred embodiment of the invention and shown in the appended figures, the protuberances 10 of the cross bars 9 are rectilinear and extend between two opposite side walls 7 of the metal structure. Particularly, the cross bars 9 are made of metal section bars having an "L" and/or "U"-shaped cross-section. The protuberances 10 are defined by free edges of the metal section bars. It shall be noticed that, as illustrated in the appended figures, the cross bars 9, in association with the side walls 7 and the bottom wall 6, divide the collection tank into sectors. Such sectors are in a mutual fluid communication through through openings obtained in the cross bars 9.

As stated above, the plates 3 are intended to constrain resting on the support structure 2. To this aim, each plate 3 comprises a first 3*a* and a second 3*b* surfaces that are mutually opposite. The first surface 3*a* is provided with grooves 11 (FIGS. 3 and 4) designed to engage corresponding protuberances 10 of the cross bars 9. More particularly, the groove 11 is dimensioned to receive the protuberance 10 so that the depth of the groove 11 abuts against the free end of the protuberance 10. In this manner, the plates are mutually placed adjoining so as to close said collection tank without a fluid seal and to create a resting surface for the user of the shower tray. The plates unload their weight peso (and the user's weight) onto the cross bars 9, which, in turn, unload the weight onto the bottom wall 6 of the metal structure, imparting an excellent stability to the shower tray. Furthermore, to allow an easy installation of the metal structure 2, the latter is provided with a plurality of adjustable supports 12 arranged in the proximity of the bottom wall 6. The adjustable supports are arranged to change the height from the ground of the metal structure and, in the preferred embodiment, they are constrained to the lower peripheral frame 5 and extend away therefrom in the opposite direction to the upper peripheral frame 4 (as schematically illustrated in FIG. 4).

The mutual adjoining of the plates does not close the collection tank in a fluid seal, but implements also sub-millimeter apertures between the plates, allowing the water to outflow through such apertures and reach the collection tank. Particularly, between the plate immediately adjacent to the upper peripheral frame 4 and the latter, an opening is present, having a width ranging between 0.5 mm and 5 mm. Such opening extends peripherally along the entire upper peripheral frame 4 so as to prevent the water from being able to directly flow onto the frame.

In the preferred embodiment of the invention, each first surface 3*a* of the plates 3 comprises two grooves 11 that are substantially rectilinear and arranged in the proximity of the free edges of the plate, so that each plate is supported by two protuberances 10. Advantageously, the coupling between the plates and the cross bars is of the removable type, so that the plates can be removed from their seats to allow a direct access to the collection tank.

Figure 3:
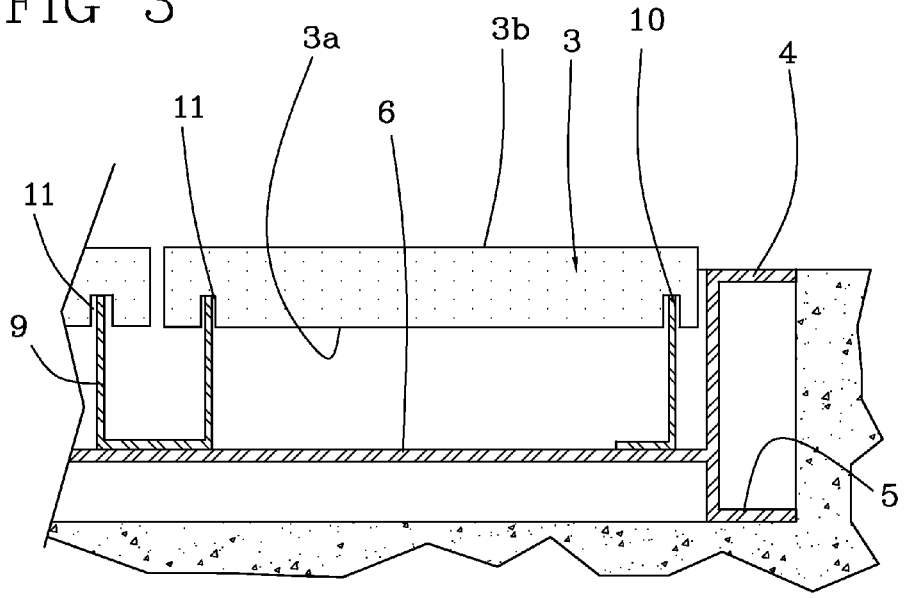
FIGS. 3 and 4 are sectional views of the shower tray of FIG. 1 in two operative configurations.
Figure 4:
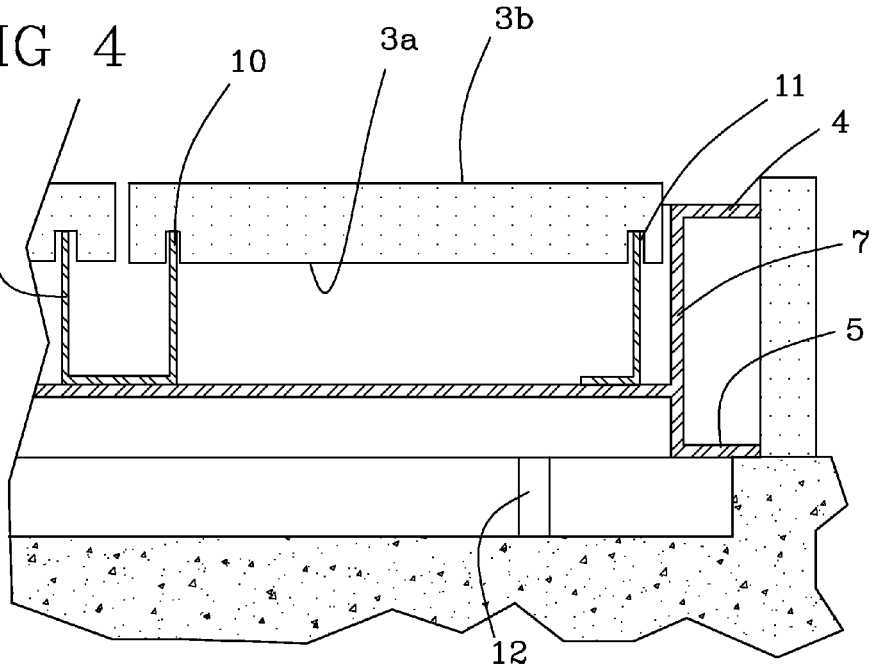

It shall be noticed that the thickness of each plate and the depth of the grooves 11 obtained thereon are selected so that the groove can stably receive the corresponding protuberance, and so that the second surface of the plate (the surface defining the resting plane for the user) emerges with respect to the plane defined by the upper peripheral frame 4 (see FIGS. 3 and 4).

The materials of which the plates 3 are made can be selected as a function of the aesthetical needs. For example, the plates can be made of marble or a similar material, ceramic, metal, or still other materials.

In order to install the shower tray, it is sufficient to locate the metal structure in an excavation obtained in the screed or to constrain the metal structure directly above the screed. In the first case, providing for an excavation having a depth that is at least equal to the overall height of the metal structure 2, the shower tray will be installed flush with the floor (as schematically illustrated in FIG. 3). In the second case, the shower tray will be located in elevation with respect to the floor. In the latter case, in order to make the shower tray aesthetically more performant, shoulders can be provided (for example, in the same material as the plates 3) having an height that is equal or higher than the overall height of the metal structure and the application thereof between the upper frame 4 and the lower frame 5, thereby masking the visible part of the metal structure 2 (as illustrated in FIG. 4).

The invention achieves the aimed objects.

In fact, the same metal structure 2 can be provided with plates 3 of different chromatic types and different material, therefore allowing the use of a single metal structure 2 for the exposure of a plurality of aesthetical variants of a same shower tray.

Furthermore, the same metal structure 2 can be used to install the shower tray flush with the floor or in elevation, considerably reducing the space necessary for storing and displaying the sower trays.

It shall be apparent that those skilled in the art, in order to meet contingent, specific needs, will be able to make a number of modifications and variations to the shower tray described above, such as, for example, providing a metal structure having an arched instead of quadrangular shape. Again, a containment wall of a shower cabin can be constrained to the upper peripheral frame. Such variations and modifications anyhow fall within the protection scope of the invention as defined by the following claims.

The invention claimed is:

1. A shower tray comprising a structure made of a metal material, and a plurality of plates, said structure of metal material comprising an upper peripheral frame, a bottom wall, and side walls joining said upper peripheral frame to said bottom wall to define a collection tank, said metal structure comprising at least one hole designed to be connected to a drain pipe, said structure of metal material further comprising a plurality of cross bars extending between two opposite side walls, arranged in contact with said bottom wall and comprising protuberances projecting on the opposite side with respect to the bottom wall, each plate of said plurality of plates comprising a first and a second surfaces that are mutually opposite, said first surface comprising grooves designed to engage corresponding protuberances of said cross bars.

2. The shower tray according to claim 1, wherein said cross bars, in combination with said side walls and said bottom wall, divide said collection tank into sectors; said cross bars being provided with through openings to put said sectors in fluid communication.

3. The shower tray according to claim 1, wherein said protuberances of the cross bars are rectilinear and extend between two opposite side walls of said metal structure.

4. The shower tray according to claim 3, wherein said cross bars are metal section bars having an "L" and/or "U"-shaped cross-section; said protuberances being defined by free edges of said section bars.

5. The shower tray according to claim 1, wherein said plates are mutually placed adjoining so as to close said collection tank without a fluid seal.

6. The shower tray according to claim 1, wherein each first surface of said plates comprises two grooves that are substantially rectilinear and arranged in the proximity of free edges of the plate.

7. The shower tray according to claim 1, wherein an opening is present between a plate and said upper frame, having a width ranging between 0.5 mm and 5 mm.

8. The shower tray according to claim 1, wherein said metal structure comprises adjustable supports arranged in the proximity of the bottom wall.

9. The shower tray according to claim 1, wherein said plates are removably hold rested on said metal structure.

10. The shower tray according to claim 1, wherein the thickness of each plate and the depth of the grooves are selected so that the second surface of the plate lies on an elevation plane with respect to a plane defined by the upper peripheral frame.

* * * * *